US005381856A

United States Patent [19]

Fujikura et al.

[11] Patent Number: 5,381,856

[45] Date of Patent: Jan. 17, 1995

[54] PROCESS FOR PRODUCING VERY THIN AMORPHOUS ALLOY STRIP

[75] Inventors: Masahiro Fujikura; Takashi Sato; Toshio Yamada; Fumio Hasebe; Hiromi Chida, all of Kawasaki, Japan

[73] Assignee: Nippon Steel Corporation, Tokyo, Japan

[21] Appl. No.: 132,546

[22] Filed: Oct. 6, 1993

[30] Foreign Application Priority Data

Oct. 9, 1992 [JP] Japan ..... 4-271974

[51] Int. Cl.[6] ..... B22D 11/06

[52] U.S. Cl. ..... 164/463; 164/475

[58] Field of Search ..... 164/463, 423, 475, 415

[56] References Cited

FOREIGN PATENT DOCUMENTS 61-5820 2/1986 Japan .
63-215348 9/1988 Japan .
2-18665 4/1990 Japan .
3-90547 4/1991 Japan .

OTHER PUBLICATIONS

The 26th Seminar of the 147th Committee of Amorphous Materials in Japan Society for the Promotion of Science Journal of Materials Science 16 (1981) pp. 2419–2433, "Production of Metallic Glass Ribbons by the Chill-Block Melt-Spinning Technique in Stabilized Laboratory Condition", Davor Pavuna.

International Journal of Rapid Solidification, 1991, vol. 6, pp. 285–295, "Effect of Arc Plasma Heating on the Air Pocket Formation During the Planar Flow Casting", Wen-Kuan Wang, et al.

*Primary Examiner*—Kuang Y. Lin
*Attorney, Agent, or Firm*—Kenyon & Kenyon

[57] ABSTRACT

According to the present invention, in the PFC (planar flow casting) method, He gas at room temperature is blown onto the surface of a cooling roll at a flow rate of 0.1 to 5 liters/min·cm$^2$ through a He gas blow nozzle provided upstream of a molten alloy (a puddle) ejected through a molten alloy ejection nozzle onto the surface of the cooling roll at a distance from the ejection nozzle, the distance from the surface of the cooling roll and an angle of inclination of the nozzle within respectively specified ranges, thereby forming a He gas atmosphere around the puddle, and a thin strip is dragged out of said puddle. This enables a thin amorphous alloy strip having a very small thickness and a smooth surface free from significant uneven portions and pores to be easily produced at a low cost without use of any vessel for regulating the atmosphere or an apparatus for heating the blown gas.

1 Claim, 3 Drawing Sheets

PROCESS FOR PRODUCING VERY THIN AMORPHOUS ALLOY STRIP

BACKGROUND OF THE INVENTION

1. Field of the Invention

The present invention relates to a process for producing a very thin amorphous alloy strip suitable for applications such as saturable reactors, noise filters, choke coils, other inductors, various transformers and magnetic heads, and excellent in magnetic properties such as iron loss, magnetic permeability and squareness ratio, particularly in at a high frequency.

2. Description of the Prior Art

Thin strips of amorphous alloys are mainly produced by a method called a "single roll method" which comprises spraying a molten metal against a roll being rotated at a high speed to rapidly cool the metal. The single roll method is roughly classified into a planar flow casting method (hereinafter referred to as "PFC method") and a chill block melt spinning method (hereinafter referred to as "CBMS method"). The PFC method is characterized in that use is made of a slit nozzle and the space between the roll and the nozzle is limited to 0.03 to 1 mm to support a basin (a puddle) between the roll and nozzle (see Japanese Examined Patent Publication (Kokoku) No. 61-5820). This method is more suitable for the production of a thin strip having a more homogeneous sheet thickness and a larger width than a thin strip produced by the CBMS method that does not limit the space between the roll and the nozzle. A reduction in the thickness of a thin strip of an amorphous alloy to a very small value using the PFC method and CBMS method has been studied for the purpose of coping with an increase in the operating frequency of electronic equipment in recent years.

Yagi and Sawa et al. (see Japanese Unexamined Patent Publication Nos. 63-215348 and 3-90547 and page 6 of Material for the 26th Seminar of the 147th Committee on Amorphous Materials in the Japan Society for the Promotion of Science) disclose a process for producing a very thin amorphous alloy, characterized in that a very thin amorphous alloy strip is produced by the single roll method in an atmosphere evacuated close to vacuum. The production of a very thin amorphous alloy strip in the evacuated atmosphere causes the amount of gas entrapped between the chilling face of the roll and the molten metal to be reduced, which makes it possible to provide a thin amorphous alloy strip having a small sheet thickness and a smooth surface. The thin amorphous alloy strip thus obtained has excellent magnetic properties at a high frequency. Since, however, the production thereof in the above-described evacuated atmosphere is likely to give rise to occurrence of seizure of the molten metal on the roll, the yield is low. Further, the size of facilities needs to be large, so that the above-described process is disadvantageous also in profitability.

Davor Pavuna (see Journal of Materials Science, 16 (1981) 2419–2433) discloses that, in the CBMS method, helium (He) is blown against the puddle to stabilize the puddle. In this case, He serves to reduce the instability of the puddle observed in the CBMS method. In this method, the resultant thin strip has an average sheet thickness of 24.6 μm at the smallest and a smoothness of 4 μm in terms of the variation of the thickness. The sheet thickness and smoothness are equivalent to a thin strip provided by the conventional PFC method, so that the thin strip is unsatisfactory as a very thin amorphous strip having a smooth surface.

Howard Host Riverman (see Japanese Examined Patent Publication (Kokoku) No. 2-18665) discloses a process for producing a metallic strip by the single roll method or the like, characterized in that an inert gas ($N_2$, He, Ne, Ar, Kr, Xe or their mixture) heated to reduce the density is blown in a rapid cooling zone to provide a thin amorphous alloy strip having a smooth surface. Although this process needs no special low pressure vessel, the smoothing effect cannot be attained without reducing the density of the inert gas to be sprayed. Further, this publication describes that "In order to provide a desired low density atmosphere, the gas is heated to at least 800 K, preferably 1300 K." That is, the use of a gas at 800 K or above is indispensable.

Further, Wen-Kuan Wang et al. (see International Journal of Rapid Solidification, 6 (1991) 285–295) have succeeded in providing a thin strip having a smooth surface portion free from an air pocket by heating a gas upstream of the puddle with an arc plasma in the PFC method. Since, however, the roll surface becomes very roughened, this process is unsuitable for use in casting for a long period of time. Further, since the surface of the roll reaches a high temperature, difficulties will be encountered in providing rapid cooling conditions that enable the thin amorphous alloy strip to be stably produced for a long period of time.

As described above, a very thin amorphous strip has hitherto been provided by using an evacuated atmosphere or blowing a heated inert gas. For these purposes, it is necessary to use a vessel for regulating the atmosphere and an apparatus for heating a blowing gas, which is unfavorable from the viewpoint of profitability.

An object of the present invention is to 30 provide a process for producing a thin amorphous alloy strip that can cope with an increase in operating frequency and enables a thin amorphous alloy strip having a very small thickness and a smooth surface free from significant uneven portions and pores to be easily produced, without use of any vessel for regulating the atmosphere and an apparatus for heating a blowing gas, at a low cost.

SUMMARY OF THE INVENTION

In order to solve the above-described problems, that is, in order to enable a thin amorphous alloy strip to be produced in air that is advantageous from the viewpoint of profitability, the present inventors have selected a system where a gas flows during production. In this connection, the present inventors have repeated experiments with the kind of gases used, the gas generating system, the position of the outlet for the gas, the angle for the gas flow, the gas flow rate, etc. being varied. As a result, they have found that a very thin amorphous strip having a smooth surface can be stably produced without applying heat to the He gas by flowing He at a very low flow rate upstream of the molten metal under particular conditions.

That is, the present invention relates to a process for producing a thin amorphous alloy strip by a PFC method, wherein a He gas at room temperature is blown at an upstream side of a molten alloy ejected through a molten alloy ejection nozzle, that is, at an upstream side of a cooling roll in the direction of rotation thereof under such a condition that the opening of the He gas blow nozzle is provided 2 to 40 mm upstream from the surface of the cooling roll at a position corresponding to the center portion of an opening of the ejection nozzle towards the rotation of the cooling roll and 0.1 to 30 mm above the surface of the cooling roll. The He gas blow nozzle is provided at an upstream side of the rotation of the cooling roll at an angle of inclination in the range of from −10° to 45° and the He gas is blown against the molten metal through the He gas blow nozzle at a flow rate of 0.1 to 5 liters/min·cm$^2$ in terms of the flow rate per unit sectional area of the opening of the He gas blow nozzle.

Blowing the He gas under the above-described conditions causes the He gas, even at room temperature, to surround the circumference of a puddle ejected from the ejection nozzle and formed on the surface of the cooling roll while maintaining the laminar flow to form a He gas atmosphere, which minimizes the trapping of the He gas in the puddle, so that the occurrence of an air pocket at the puddle portion can be sufficiently prevented.

Therefore, according to the present invention, a very thin amorphous alloy strip free from pinholes, having a high surface smoothness, that is, excellent surface properties, can be produced even when use is made of a He gas at room temperature.

DESCRIPTION OF THE PREFERRED EMBODIMENTS

Figure 1:
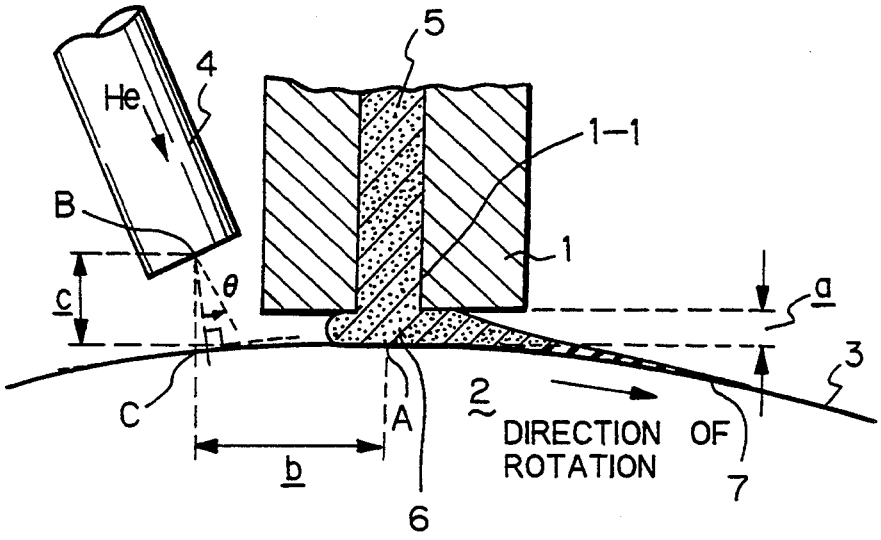
FIG. 1 is a schematic view of an apparatus for the production of the very thin amorphous strip according to the present invention.

At the outset, the present inventors have studied the relationship between the position of a molten alloy ejection nozzle and the position of a nozzle for blowing the room temperature He gas in a very thin amorphous strip production apparatus shown in FIG. 1.

In the drawing, a cooling roll 2 having a cooling surface 3 is rotated in one direction at a constant peripheral speed, and a molten alloy ejection nozzle 1 having a slit opening 1—1 is provided immediately above the cooling roll 2 in such a manner that the longitudinal direction of the ejection nozzle 1 is perpendicular to the direction of movement of the cooling surface 3.

The gap a is the distance between the nozzle 1 and the surface 3 of the cooling roll and my be properly set depending upon the kind of the alloy material. Reference numeral 6 is a puddle.

A He gas blow nozzle 4 is provided near the cooling roll 2 and upstream side of the rotation of the cooling roll, that is, upstream of the puddle 6. In this connection, the distance b is a distance from the surface 3 of the cooling roll at its position A corresponding to the center portion of an opening portion 1—1 of the molten alloy ejection nozzle 1 to the surface 3 of the cooling roll at its position C corresponding to the center B of the opening of the nozzle 4, and the distance c is a distance from the center B to the position C.

The angle $\theta$ is an angle of inclination of the blow nozzle 4, towards the downstream side of the rotation of the cooling roll, that is formed with a line normal to the surface 3 of the cooling roll. The direction of inclination towards the downstream side of the rotation of the cooling roll from the perpendicular line to the surface of the cooling roll is expressed as "+", while the reverse direction of inclination is expressed as "−".

In this connection, the present inventors melted a mother alloy having a composition of $Co_{69}Fe_4Si_{16}B_9Mo_2$ which was then poured into the ejection nozzle 1 and ejected on the surface 3 of the cooling roll 2 to provide a very thin amorphous strip.

In this case, the distance c at the He gas blow nozzle 4 was set at 5 mm, and the angle $\theta$ of inclination was set at 0° with the distance b being varied to provide thin strips having a profile thickness of about 11 μm. The flow rate of He at room temperature was 5 liters/min (3.3 liters/min·cm$^2$) .

In the present invention, the sheet thickness was measured by the following two methods. In one method, the section of the thin strip was observed with an optical microscope to determine a profile thickness $t_a$ wherein the presence of air pockets has been ignored. In the second method, an average sheet thickness $t_b$ was determined from the weight length, width and density of the thin strip. The presence of an air pocket renders the $t_b$ value smaller than the $t_a$ value. That is, the closer the $t_b$ value to the $t_a$ value, the smaller the volume of the air pockets and the smoother the surface. The smoothness is defined as tb/ta. The profile sheet thickness $t_a$, average sheet thickness $t_b$, smoothness $t_b/t_a$ and number of pinholes (n) per unit length are given in Table 1. When the distance b value was 1.0 mm, a thin strip could not be produced due to the clogging of the nozzle during the production of the thin strip. On the other hand, when the distance b was 45 mm, He was dispersed, so that the effect of preventing air pockets could not be attained.

TABLE 1

| Sample | Distance from nozzle slit, b(mm) | Profile sheet thickness, $t_a$(μm) | Average sheet thickness, $t_b$(μm) | Smoothness, $t_b/t_a$ (%) | Pinhole density, n (pinholes/m) |
|---|---|---|---|---|---|
| 8 | 1.0 (Comp. Ex.) | | Thin strip not provided | | |
| 9 | 5 (Ex.) | 10.9 | 10.4 | 95.4 | None |
| 2 | 10 (Ex.) | 11.0 | 10.5 | 95.5 | None |
| 10 | 20 (Ex.) | 11.1 | 10.1 | 91.0 | None |
| 11 | 45 (Comp. Ex.) | 11.0 | 7.0 | 63.6 | About 140 |

Figure 2:
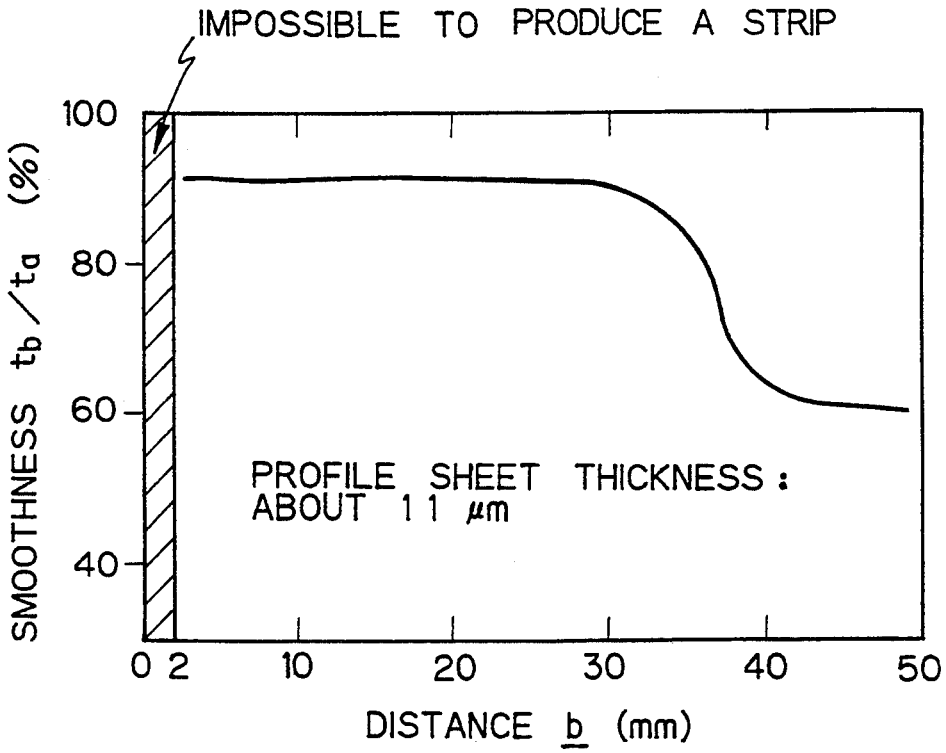
FIG. 2 is a diagram showing the relationship between the distance b from the center portion of an opening of a molten alloy ejection nozzle to the center of an opening of a He gas blow nozzle and the smoothness of the resultant thin strip ($t_b/t_a$)

Among the results given in Table 1, the relationship between the distance b and the smoothness $t_b/t_a$ of the resultant thin strip is shown in FIG. 2. When the distance b was less than 2 mm, a thin strip was not formed. On the other hand, when the distance b exceeded 40 mm, the smoothness of the thin strip was reduced and became the same as that of the thin strip when no He gas flowed.

Then, thin strips having a profile thickness of about 11 μm were prepared under conditions where the distance b at the He gas blow nozzle was 10 mm and the angle θ of inclination was 0° with the distance c being varied in the same manner as that described above.

The profile sheet thickness, $t_a$, average sheet thickness $t_b$, smoothness $t_b/t_a$, and number of pinholes (n) per unit length are given in Table 2. When the distance c was 40 mm, He was dispersed, so that the effect of preventing air pockets could not be attained.

TABLE 2

| Sample | Distance from cooling roll, c (mm) | Profile sheet thickness, $t_a$(μm) | Average sheet thickness, $t_b$(μm) | Smoothness, $t_b/t_a$ (%) | Pinhole density, n (pinholes /m) |
|---|---|---|---|---|---|
| 2 | 5 (Ex.) | 11.0 | 10.5 | 95.5 | None |
| 12 | 20 (Ex.) | 10.8 | 9.8 | 90.7 | None |
| 13 | 40 (Comp. Ex.) | 11.0 | 8.0 | 72.7 | About 60 |

Figure 3:
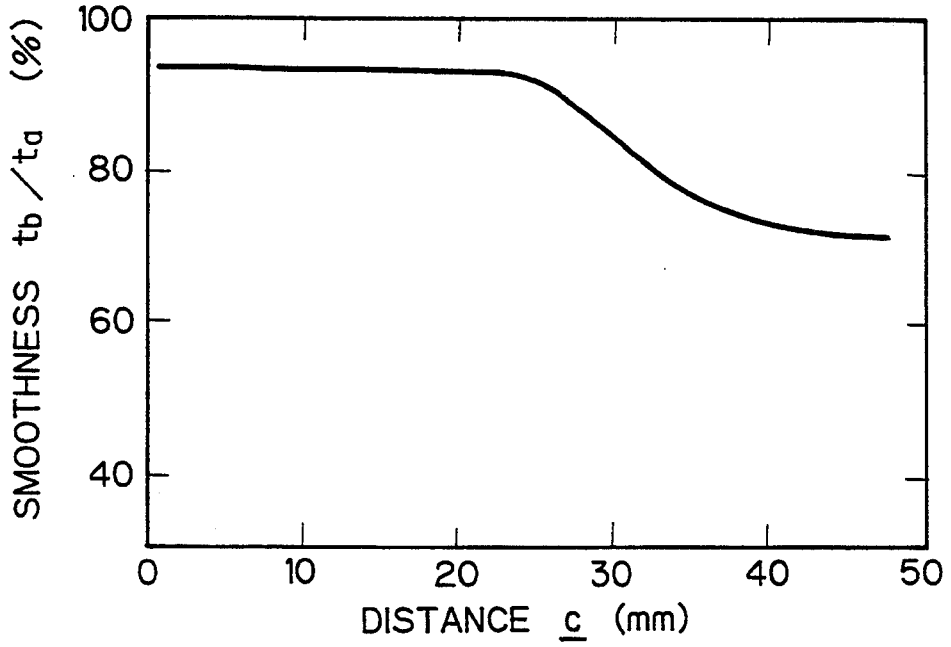
FIG. 3 is a diagram showing the relationship between the distance c from the center of an opening of a He gas blow nozzle to the surface of a cooling roll and the smoothness of the resultant thin strip ($t_b/t_a$)

From the results given in Table 2, the relationship between the distance c and the smoothness $t_b/t_a$ of the resultant thin strip is shown in FIG. 3.

When the distance c exceeded 30 mm, the smoothness of the thin strip was reduced and became the same as that of the thin strip when no He gas flowed.

Then, thin strips having a profile thickness of about 11 μm were prepared under conditions where the distance b was 10 mm and the distance c was 5 mm and the angle θ of inclination of the He gas blow nozzle was varied in the manner described above. The profile sheet thickness $t_a$, average sheet thickness $t_b$, smoothness $t_b/t_a$, and number of pinholes (n) per unit length are given in Table 3. When the θ value was −30°, He was dispersed, while when it was 70°, the puddle became unstable, so that in both the above cases, the effect of preventing air pockets could not be attained.

TABLE 3

| Sample | Angle of He flow outlet, θ (°) | Profile sheet thickness, $t_a$(μm) | Average sheet thickness, $t_b$(μm) | Smoothness, $t_b/t_a$ (%) | Pinhole density, n (pinholes/m) |
|---|---|---|---|---|---|
| 14 | −30 (Comp. Ex.) | 11.0 | 7.0 | 63.6 | About 140 |
| 2 | 0 (Ex.) | 11.0 | 10.5 | 95.5 | None |
| 15 | 30 (Ex.) | 10.9 | 10.1 | 92.7 | None |
| 16 | 70 (Comp. Ex.) | 11.0 | 8.0 | 72.7 | About 60 |

Figure 4:
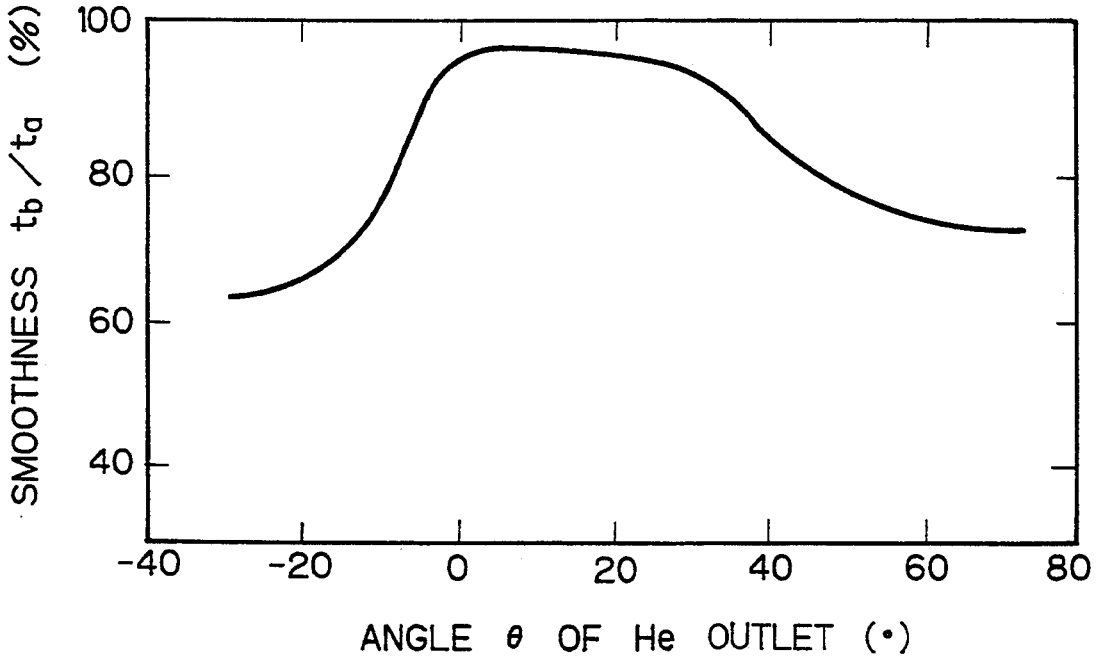
FIG. 4 is a diagram showing the relationship between an angle $\theta$ of inclination of a He gas blow nozzle and the smoothness of the resultant thin strip ($t_b/t_a$)

Among the results given in Table 3, the relationship between the angle θ of inclination and the smoothness $t_b/t_a$ of the resultant thin strip is shown in FIG. 4.

When the angle θ of inclination was less than −10° C., He was dispersed, so that the intended effect could not be attained. On the other hand, when it exceeded 45°, the puddle became so unstable that the smoothness of the thin strip was lowered and became the same as that of the thin strip when no He gas flowed.

Finally, thin strips having a profile thickness of about 11 μm were prepared under conditions where the size of the outlet of the He gas blow nozzle was 5 mm×30 mm, the distance b was 10 mm, the distance c was 5 mm and the angle θ of inclination was 0° with the flow rate of the He gas being varied.

The profile sheet thickness $t_a$, average sheet thickness $t_b$, smoothness $t_b/t_a$, and number of pinholes (n) per unit length are given in Table 4. When the flow rate of He gas per unit sectional area of the outlet was 0.07 liters/min·cm², He was dispersed, while when it was 10.0 liters/min·cm², the puddle became unstable, so that in both the above cases, the effect of preventing air pockets could not be attained.

TABLE 4

| Sample | He flow rate per unit sectional area of He flow outlet (1/min · cm²) | He flow rate (1/min) He flow outlet, 5 mm × 30 mm | Profile sheet thickness, $t_a$(μm) | Average sheet thickness, $t_b$(μm) | Smoothness, $t_b/t_a$ (%) | Pinhole density, n (pinholes/m) |
|---|---|---|---|---|---|---|
| 17 | 0.07 (Comp. Ex.) | 0.1 | 11.1 | 8.0 | 72.1 | About 80 |
| 18 | 0.67 (Ex.) | 1.0 | 11.2 | 10.0 | 89.3 | None |
| 2 | 3.33 (Ex.) | 5.0 | 11.0 | 10.5 | 95.5 | None |
| 19 | 10.0 (Comp. Ex.) | 15.0 | 11.3 | 9.2 | 81.4 | About 40 |

Figure 5:
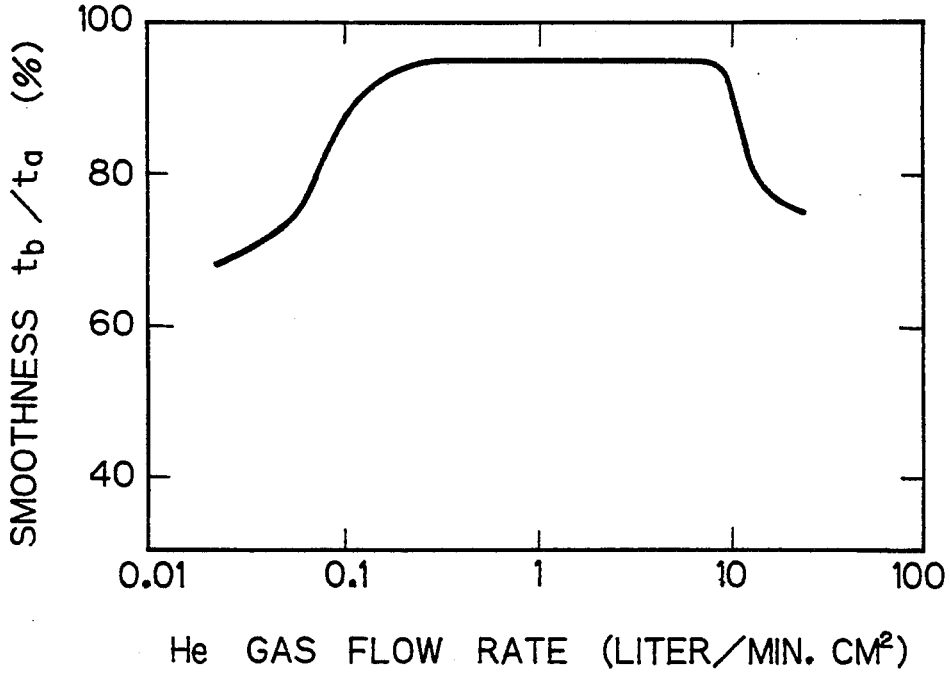
FIG. 5 is a diagram showing the relationship between the He gas flow rate per unit area of an opening of a He gas blow nozzle and the smoothness of the resultant thin strip ($t_b/t_a$).

From the results given in Table 4, the relationship between the flow rate of He gas and the smoothness $t_b/t_a$ of the resultant thin strip is shown in FIG. 5.

When the flow rate of He gas was less than 0.1 liter/min·cm², He was dispersed, while when it exceeded 5 liters/min·cm², the puddle became unstable, so that in both the above cases, no improvement in the smoothness could be attained.

The above-described various conditions can be summarized as follows.

When the distance b is less than 2 mm, the distance c is less than 0.1 mm, the angle θ is larger than 45°, the flow rate of He gas is larger than 5 liters/min·cm² and He gas is directly blown against the molten metal, the resultant thin strip has many pores and uneven portions, because the gas flow is liable to become turbulent, the puddle becomes unstable and trapping of gas in the puddle becomes significant. Further, the nozzle is unfavorably cooled to cause clogging of the nozzle. When the distance b is larger than 40 mm, the distance c is larger than 30 mm, the angle θ is less than −10° and the flow rate is less than 0.1 liter/min·cm², since He has a low molecular weight, it is unfavorably dispersed in the air, so that the effect of preventing the occurrence of the air pocket is lost. In this connection, it is noted that no problem arises even when the direction of flow of He gas is somewhat behind the puddle ($-10° \leqq \theta \leqq 0°$). This is because He gas is drawn and moved towards the puddle on the roll surface by the rotation of the roll.

The above-described experiments have revealed that, when use is made of a He gas at room temperature, it is essential that an opening of a He gas blow nozzle be provided 2 to 40 mm (2 mm≦b≦40 mm) upstream of the opening of the molten alloy ejection nozzle and 0.1 to 30 mm (0.1 mm≦c≦30 mm) immediately above the surface of the cooling roll, the direction of flow of He gas be inclined at an angle in the range of from −10° to 45° ($-10° \leqq \theta \leqq 45°$) to the direction of movement of the surface of the cooling roll and the He gas flow rate be in the range of from 0.1 to 5 liters/min·cm² in terms of the flow rate per unit sectional area of the opening of the He gas blow nozzle.

Specifically, when the above-described conditions are satisfied, the He gas flows onto the surface of the cooling roll at a position upstream of the puddle without being directly blown against the puddle (molten alloy) and is moved on the surface of the cooling roll to the vicinity of the puddle to produce a He atmosphere in the vicinity of the puddle. Since the atomic weight of He is as low as 4, the Reynols' number of the gas stream remains low, which renders the gas stream laminar, so that the trapping of the gas in the puddle is minimized. Thus, the occurrence of air pockets can be sufficiently prevented even when the He gas is used at room temperature.

It is noted that, when use was made of inert gases other than He adopted in the present invention, for example, $N_2$, Ne and Ar, for forming an atmosphere of these gases around the puddle according to the process of the present invention, the effect of preventing the occurrence of air pockets could not be attained because the atomic weight thereof is higher than that of He.

Although the opening of the He gas blow nozzle is preferably made of heat-resisting ceramics, such as quartz glass and alumina, it may be made of metals having a good workability, such as copper and brass. Further, in order to sufficiently surround the puddle with He in the longitudinal direction (in the direction of width of the thin strip) of the nozzle, it is preferred for the opening of the outlet to have a side which is half the length of the opening for the molten metal.

The mother alloy is prepared by mixing Fe, Co, Ni, Cr, Sn, Mo, Si, B, C, etc. with each other so as to have a desired composition depending upon the applications and melting the mixture to alloy them with each other. The cooling roll is made of Cu, Fe, Cu-Be alloy or other metal having a good thermal conductivity, and the surface thereof may be plated with Ni, Or, Cu or other metal. The molten metal ejection nozzle comprises quartz, alumina ($Al_2O_3$), $Si_3N_4$, $ZrB_2C$ or the like, and a single slit nozzle is preferred. The single slit nozzle is a nozzle having only one slit opening having a width of 0.1 to 1.0 mm as measured in the direction of movement of the surface of the cooling roll. Gas pressure for ejecting the molten alloy, the distance between the nozzle and the cooling surface of the cooling roll and the peripheral speed of the cooling roll are preferably 0.05 to 1 kg/cm$^2$G, 1 mm or less and 10 to 40 m/sec, respectively.

EXAMPLE

The present invention will now be described in more detail with reference to the following Example.

After a mother alloy having a composition of $Co_{69}Fe_4Si_{16}B_9Mo_2$ was prepared, 500 g of the mother alloy was melted by high-frequency heating. The molten mother alloy was passed through a nozzle having a slit opening and ejected onto the surface of a cooled copper roll being rotated at a peripheral speed of 24 m/sec to prepare a thin amorphous strip. The ejection nozzle used was a single slit (width: 0.2 to 0.3 mm, length: 5 mm) and fixed so that the slit face was parallel to the surface of the cooling roll and the longitudinal direction of the slit was normal to the direction of movement of the roll. A He gas blow nozzle was fixed so that the opening of the He gas blow nozzle was located 10 mm upstream of the puddle (b=10 mm) and 5 mm away from the surface of the cooling roll (c=5 mm). The direction of flow of the He gas was normal ($\theta=0°$) to the surface of the cooling roll. The size of the opening of the He gas blow nozzle was 5 mm×30 mm, and the flow rate of He was 5 liters/min (3.3 liters/min·cm$^2$).

Thin amorphous strips having a varied sheet thickness were prepared by varying the ejection pressure and slit width of the nozzle.

The profile sheet thickness $t_a$, average sheet thickness $t_b$, smoothness $t_b/t_a$, and number of pinholes (n) per unit length of the thin strips prepared according to the process of the present invention are given in Table 5. For comparison, the data on thin strips prepared by flowing Ar at a flow rate of 1 liter/min·cm$^2$ instead of He and thin strips prepared without flowing any gas are also given in Table 5. From the table, it is apparent that thin strips having a smooth surface can be effectively provided with a thickness of 12 μm or less.

Then, wound cores having a weight of 3.5 to 4.5 kg and in the form of a toroid having an outer diameter of 18 mm and an inner diameter of 12 mm were prepared from the thin strips prepared above. The wound cores were heat-treated by holding them at 450° C. in an Ar atmosphere for 1 hr while applying a magnetic field of 100e. For each sample, the coercive force and squareness at 100 kHz and 500 kHz were measured with a B-H analyzer, and the results are given in Table 5. As is apparent from the table, the present invention can provide thin strips excellent in magnetic properties at a high frequency, particularly in squareness ratio.

TABLE 5

| Sample | Gas flow | Profile sheet thickness $t_a$(μm) | Average sheet thickness $t_b$(μm) | Smoothness, $t_b/t_a$ (%) | Pinhole density, n (pinholes/m) | 100 kHz coercive force, Hc(A/m) | 100 kHz squareness ratio, Br/Bs(%) | 500 kHz coercive force, Hc(A/m) | 500 kHz squareness ratio, Br/Bs (%) |
|---|---|---|---|---|---|---|---|---|---|
| 1 | He flow | 12.0 | 10.9 | 90.8 | None | 9.6 | 98.4 | 19.7 | 98.5 |
| 2 | (Ex.) | 11.0 | 10.5 | 95.5 | None | 9.0 | 98.6 | 18.4 | 97.9 |
| 3 | | 9.1 | 7.8 | 85.7 | None | 8.4 | 96.0 | 16.2 | 95.4 |
| 4 | Ar flow | 11.8 | 9.4 | 79.7 | About 50 | 9.8 | 92.0 | 19.2 | 92.2 |
| 5 | (Comp. Ex.) | 11.1 | 6.9 | 62.2 | About 140 | 8.9 | 91.9 | 18.4 | 91.8 |
| 6 | No gas flow | 11.9 | 9.5 | 79.8 | About 70 | 9.8 | 92.8 | 18.8 | 93.5 |
| 7 | (Comp. Ex.) | 11.3 | 7.4 | 65.5 | About 110 | 9.0 | 92.6 | 18.2 | 92.2 |

We claim:

1. A process for producing a very thin amorphous alloy strip, comprising the steps of:

blowing a He gas at room temperature through a He gas blow nozzle onto the surface of a cooling roll being rotated in one direction, at a flow rate of 0.1 to 5 liters/min·cm$^2$ per unit sectional area of an opening of said He gas blow nozzle, a molten alloy ejection nozzle being provided immediately above said cooling roll with said He gas blow nozzle being provided on the upstream side of rotation of said cooling roll at a position of from 2 to 40 mm to the upstream side of said cooling roll in the direction of rotation thereof from a position on the surface of said cooling roll corresponding to the center of an opening of said molten alloy ejection nozzle and at a distance of from 0.1 to 30 mm above the surface of said cooling roll and at an angle of inclination in the range of from −10° to 45° to the downstream side of rotation of said cooling roll;

ejecting a molten alloy through said molten alloy ejection nozzle onto the surface of said cooling roll to form a puddle and surrounding said puddle with said He gas to form a He gas atmosphere around said puddle; and dragging said molten alloy from the puddle within said He atmosphere onto said cooling roll on the downstream side of rotation thereof to continuously produce a thin strip.

* * * * *